US009724929B2

(12) United States Patent
Yoshii et al.

(10) Patent No.: US 9,724,929 B2
(45) Date of Patent: Aug. 8, 2017

(54) LIQUID CONTAINER AND LIQUID RESIDUE DETECTION APPARATUS

(71) Applicant: CANON KABUSHIKI KAISHA, Tokyo (JP)

(72) Inventors: Kazuya Yoshii, Yokohama (JP); Hiroki Hayashi, Kawasaki (JP); Tsubasa Takaoka, Tokyo (JP); Ryo Shimamura, Yokohama (JP); Akira Shiba, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/332,604

(22) Filed: Oct. 24, 2016

(65) Prior Publication Data

US 2017/0151803 A1 Jun. 1, 2017

(30) Foreign Application Priority Data

Nov. 26, 2015 (JP) ..... 2015-230601

(51) Int. Cl.
*B41J 2/175* (2006.01)

(52) U.S. Cl.
CPC ..... *B41J 2/17566* (2013.01); *B41J 2/1752* (2013.01); *B41J 2/17513* (2013.01); *B41J 2002/17573* (2013.01)

(58) Field of Classification Search
CPC .... B41J 2/1752; B41J 2/17553; B41J 2/1753; B41J 2/17546; B41J 2/17566; B41J 2/17513
USPC ..... 347/37, 50, 86, 87
See application file for complete search history.

(56) References Cited

U.S. PATENT DOCUMENTS

| | | | | |
|---|---|---|---|---|
| 6,270,206 | B1 | 8/2001 | Shimizu et al. | 347/86 |
| 6,325,500 | B1 | 12/2001 | Kitabatake et al. | 347/86 |
| 6,347,865 | B1 | 2/2002 | Matsumoto et al. | 347/86 |
| 6,382,783 | B1 | 5/2002 | Hayashi et al. | 347/85 |

(Continued)

FOREIGN PATENT DOCUMENTS

JP 4474960 6/2010

OTHER PUBLICATIONS

U.S. Appl. No. 15/272,026, filed Sep. 21, 2016.

(Continued)

*Primary Examiner* — An Do
(74) *Attorney, Agent, or Firm* — Fitzpatrick, Cella, Harper & Scinto

(57) ABSTRACT

A liquid container can be mounted to an apparatus in which an optical sensor is installed. The liquid container has a reservoir storing a liquid, a detection chamber communicates with the reservoir and a displacement member displacing according to an amount of liquid stored in the reservoir. The displacement member has a light shielding part that moves in a first direction between a position where light of the optical sensor is shielded and a position where the light is not shielded and a regulating member regulating movement of the displacement member in a direction crossing the first direction. An inner wall of the detection chamber has a first area facing the light shielding part and transmitting the light of the optical sensor and a second area facing the regulating member. The first area and the second area are connected via a ridgeline having an inter-surface angle larger than 180 degrees.

16 Claims, 7 Drawing Sheets

(56) References Cited

U.S. PATENT DOCUMENTS

| | | | | |
|---|---|---|---|---|
| 6,402,298 | B1 | 6/2002 | Nanjo et al. | 347/49 |
| 6,422,674 | B1 | 7/2002 | Hinami et al. | 347/7 |
| 6,443,567 | B1 | 9/2002 | Hayashi et al. | 347/85 |
| 6,447,084 | B1 | 9/2002 | Uetsuki et al. | 347/7 |
| 6,450,631 | B1 | 9/2002 | Hayashi et al. | 347/86 |
| 6,471,343 | B1 | 10/2002 | Shimizu et al. | 347/85 |
| 6,474,797 | B2 | 11/2002 | Kurata et al. | 347/85 |
| 6,485,136 | B1 | 11/2002 | Shimizu et al. | 347/86 |
| 6,505,923 | B1 | 1/2003 | Yamamoto et al. | 347/85 |
| 6,511,167 | B1 | 1/2003 | Kitabatake et al. | 347/86 |
| 6,530,654 | B2 | 3/2003 | Kitabatake et al. | 347/86 |
| 6,540,321 | B1 | 4/2003 | Hirano et al. | 347/22 |
| 6,540,342 | B2 | 4/2003 | Koshikawa et al. | 347/86 |
| 6,543,886 | B1 | 4/2003 | Hattori et al. | 347/85 |
| 6,550,898 | B2 | 4/2003 | Hayashi et al. | 347/85 |
| 6,598,963 | B1 | 7/2003 | Yamamoto et al. | 347/85 |
| 6,629,758 | B2 | 10/2003 | Okamoto et al. | 347/85 |
| 6,637,872 | B2 | 10/2003 | Ara et al. | 347/85 |
| 6,692,115 | B2 | 2/2004 | Sanada et al. | 347/85 |
| 6,698,871 | B1 | 3/2004 | Hayashi et al. | 347/86 |
| 6,709,092 | B2 | 3/2004 | Hayashi et al. | 347/86 |
| 6,719,415 | B1 | 4/2004 | Hattori et al. | 347/86 |
| 6,746,110 | B2 | 6/2004 | Hayashi | 347/86 |
| 6,755,500 | B2 | 6/2004 | Hirano et al. | 347/22 |
| 6,796,645 | B2 | 9/2004 | Koshikawa et al. | 347/86 |
| 6,805,434 | B2 | 10/2004 | Hayashi et al. | 347/85 |
| 6,815,381 | B1 | 11/2004 | Yamamoto et al. | 442/187 |
| 6,827,431 | B2 | 12/2004 | Kitabatake et al. | 347/86 |
| 6,851,798 | B2 | 2/2005 | Koshikawa et al. | 347/85 |
| 6,863,762 | B2 | 3/2005 | Sanada et al. | 156/180 |
| 6,877,847 | B2 | 4/2005 | Hayashi et al. | 347/86 |
| 6,942,326 | B2 | 9/2005 | Hayashi et al. | 347/86 |
| 6,966,631 | B2 | 11/2005 | Matsuo et al. | 347/49 |
| 6,997,548 | B2 | 2/2006 | Matsuo et al. | 347/86 |
| 7,118,194 | B2 | 10/2006 | Matsuo et al. | 347/49 |
| 7,134,747 | B2 | 11/2006 | Hayashi et al. | 347/86 |
| 7,165,829 | B2 | 1/2007 | Hayashi et al. | 347/49 |
| 7,357,494 | B2 | 4/2008 | Katayama et al. | 347/86 |
| 8,011,768 | B2 | 9/2011 | Hayashi et al. | 347/86 |
| 8,016,376 | B2 * | 9/2011 | Sugahara | B41J 2/17566 347/7 |
| 8,439,491 | B2 | 5/2013 | Hayashi et al. | 347/86 |
| 8,485,642 | B2 | 7/2013 | Hayashi et al. | 347/49 |
| 8,529,035 | B2 | 9/2013 | Tsukamoto et al. | 347/86 |
| 8,529,037 | B2 | 9/2013 | Miyashita et al. | 347/86 |
| 8,960,869 | B2 | 2/2015 | Takada et al. | 347/86 |
| 8,960,875 | B2 | 2/2015 | Shiba et al. | 347/93 |
| 9,139,012 | B2 | 9/2015 | Yamada et al. | B41J 2/17553 |
| 9,242,471 | B2 | 1/2016 | Yoneda et al. | B23P 19/027 |
| 9,278,540 | B2 | 3/2016 | Seki et al. | B41J 2/17513 |
| 9,375,938 | B2 | 6/2016 | Kondo et al. | B41J 2/17513 |
| 2003/0038867 | A1 | 2/2003 | Yamamoto et al. | 347/86 |
| 2011/0209335 | A1 | 9/2011 | Yamamoto et al. | 29/505 |
| 2015/0343793 | A1 | 12/2015 | Takada et al. | B41J 2/17556 |
| 2015/0352851 | A1 | 12/2015 | Shiba et al. | B41J 2/17513 |
| 2016/0200113 | A1 | 7/2016 | Nanjo et al. | B41J 2/175 |
| 2016/0200114 | A1 | 7/2016 | Nanjo et al. | B41J 2/17553 |

OTHER PUBLICATIONS

U.S. Appl. No. 15/274,806, filed Sep. 23, 2016.
U.S. Appl. No. 15/288,879, filed Oct. 7, 2016.
U.S. Appl. No. 15/338,031, filed Oct. 28, 2016.

* cited by examiner

LIQUID CONTAINER AND LIQUID RESIDUE DETECTION APPARATUS

BACKGROUND OF THE INVENTION

Field of the Invention

The present invention relates to a liquid container and a detection apparatus for a liquid residue stored in the liquid container.

Description of the Related Art

In an apparatus in which liquid (or ink) supplied from a liquid container (or an ink tank) is continually consumed, like an inkjet printing apparatus, it may be desirable that a state in which a liquid residue in the liquid container is small be detected and notified to a user. As a configuration of detecting the liquid residue, there are provided a displacement member which is arranged within the liquid container and makes displacement along with liquid consumption and an optical sensor which detects light transmitted through the liquid container. According to such a configuration, the displacement member is adjusted such that, for example, in a case where the liquid residue within the liquid container is sufficient, it is placed at a position of shielding transmitted light of the optical sensor, and, in a case where the liquid residue within the liquid container is small, it is placed at a position of not shielding the transmitted light of the optical sensor. Then, depending on whether or not the optical sensor has detected the transmitted light, it is possible to determine whether the amount of liquid residue becomes smaller than a predetermined amount.

According to the configuration of residue detection as described above, the displacement member is required to be smoothly displaced along with liquid consumption, and placed at a position adapted to the amount of liquid residue. For example, Japanese Patent No. 4474960 discloses a configuration comprising a convex portion on a displacement member at a position facing an inner wall of a detection window in which an optical sensor detects transmitted light. Providing the convex portion ensures, even if a top end of the convex portion comes closest to an inner wall face, a sufficient distance between an area of a light shielding part other than the convex portion and the detection window, whereby surface tension of the ink interposed therebetween is suppressed to influence displacement of the light shielding part.

SUMMARY OF THE INVENTION

According to a first aspect of the present invention, there is provided a liquid container mountable to an apparatus in which an optical sensor is installed, the liquid container comprising: a reservoir storing a liquid; a detection chamber which communicates with the reservoir and which is located at a position detectable by the optical sensor in a state where the liquid container is mounted in the apparatus; and a displacement member configured to displace to a first direction in the reservoir and the detection chamber according to an amount of liquid stored in the reservoir, wherein the displacement member includes a light shielding part which moves, according to the displacement, within the detection chamber between a position where light of the optical sensor is shielded and a position where the light of the optical sensor is not shielded and a regulating member for regulating movement of the displacement member in a second direction that crosses the first direction, an inner wall of the detection chamber has a first area that faces the light shielding part and at least of a portion of that is formed of a material transmitting the light of the optical sensor and a second area that faces the regulating member in the second direction, and the first area and the second area are connected via a ridgeline having an inter-surface angle larger than 180 degrees.

According to a second aspect of the present invention, there is provided a liquid container mountable to an apparatus in which an optical sensor is installed, the liquid container comprising: a reservoir storing a liquid; a detection chamber which communicates with the reservoir and which is located at a position detectable by the optical sensor in a state where the liquid container is mounted in the apparatus; and a displacement member configured to displace to a first direction in the reservoir and the detection chamber according to an amount of liquid stored in the reservoir, wherein the displacement member includes a light shielding part which moves, according to the displacement, within the detection chamber between a position where light of the optical sensor is shielded and a position where the light of the optical sensor is not shielded and a regulating member for regulating movement of the displacement member in a second direction that crosses the first direction, an inner wall of the detection chamber has a first area that faces the light shielding part and at least of a portion of that is formed of a material transmitting the light of the optical sensor and a second area that faces the regulating member in the second direction, and the first area and the second area are connected with an inter-surface angle larger than 180 degrees.

According to a third aspect of the present invention, there is provided a liquid residue detection apparatus comprising: a mounting unit capable of mounting a liquid container therein; an optical sensor; and a determining unit configured to determine an amount of liquid residue stored in the liquid container based on a result of detection by the optical sensor, wherein the liquid container includes a reservoir storing a liquid, a detection chamber which communicates with the reservoir and which is located at a position detectable by the optical sensor in a state where the liquid container is mounted in the apparatus, and a displacement member configured to displace to a first direction in the reservoir and the detection chamber according to an amount of liquid stored in the reservoir, and wherein the displacement member includes a light shielding part which moves, according to the displacement, within the detection chamber between a position where light of the optical sensor is shielded and a position where the light of the optical sensor is not shielded and a regulating member for regulating movement of the displacement member in a second direction that crosses the first direction, an inner wall of the detection chamber has a first area that faces the light shielding part and at least of a portion of that is formed of a material transmitting the light of the optical sensor and a second area that faces the regulating member in the second direction, and the first area and the second area are connected via a ridgeline having an inter-surface angle larger than 180 degrees.

Further features of the present invention will become apparent from the following description of exemplary embodiments (with reference to the attached drawings).

DESCRIPTION OF THE EMBODIMENTS

However, according to the configuration disclosed in Japanese Patent No. 4474960, a sufficient distance is ensured between the area other than the convex portion and the detection window, but the distance between the top of the convex portion and the detection window is so small that occurrence of a capillary phenomenon therebetween may be a concern. If the capillary phenomenon occurs, even if an ink level within the ink cartridge is sufficiently lower than the convex portion, ink is held between the convex portion and the detection window, thereby raising a possibility that the light of the optical sensor may be transmitted through the held ink. If such a state occurs, there may be a concern that the amount of light to be received by the optical sensor is reduced or attenuated, failing to achieve detection with high precision.

The present invention has been made to solve the above problem. Accordingly, an object of the present invention is to provide a liquid container and a liquid residue detection apparatus that can achieve appropriate detection with high precision according to the amount of ink residue.

Figure 1:
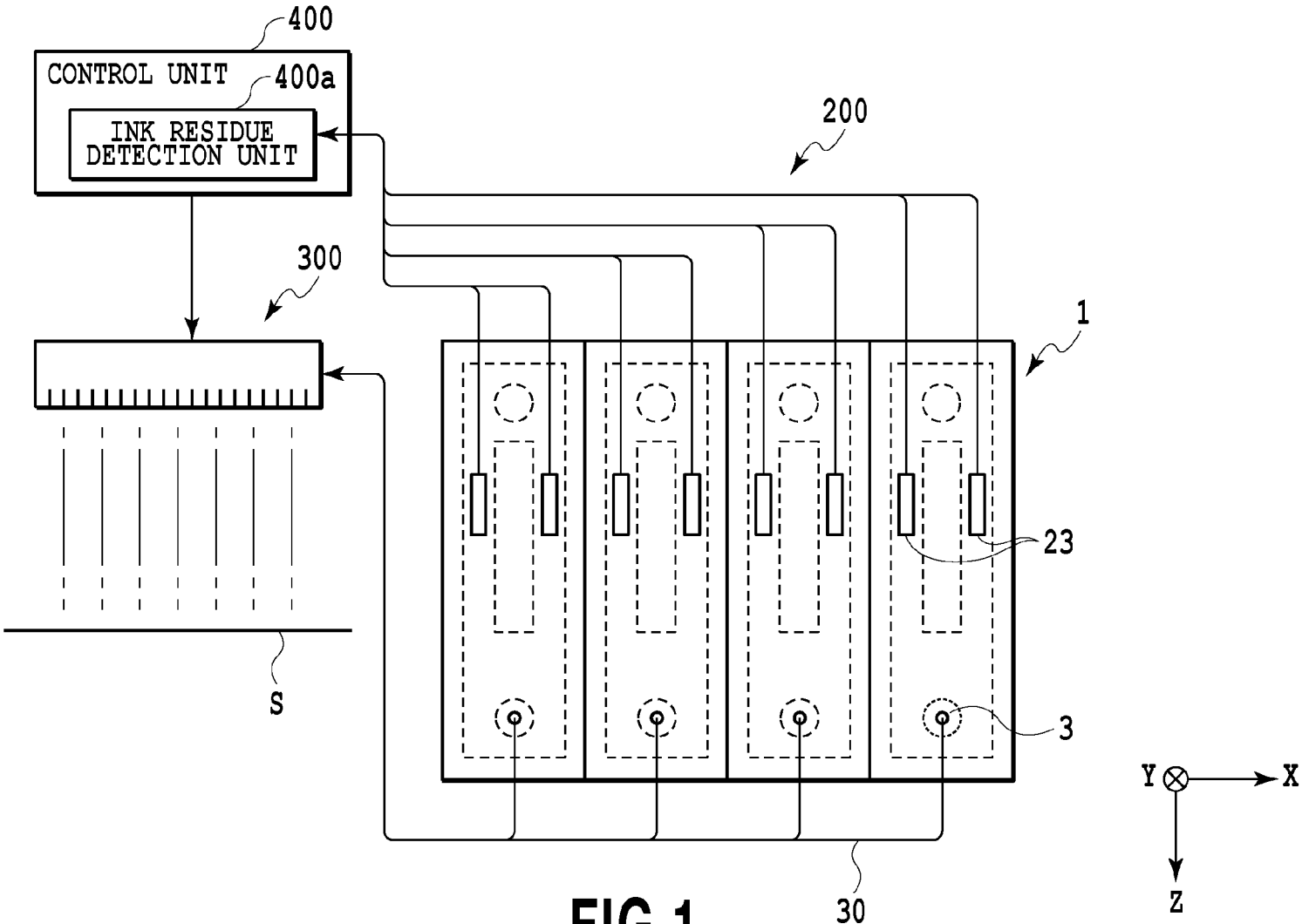
FIG. 1 is a diagram showing a schematic configuration of an inkjet printing apparatus.

FIG. 1 is a diagram showing a schematic configuration of an inkjet printing apparatus which can be used as a liquid residue detection apparatus of the present invention. An inkjet printing apparatus 200 includes one or more ink cartridges 1 which can be used as a liquid container of the present invention and which can be mounted in the inkjet printing apparatus 200 according to the number of types of inks. FIG. 1 shows four ink cartridges 1, accommodating cyan, magenta, yellow, and black inks, respectively.

The ink stored in the ink cartridge 1 is supplied to a print head 300 from a supply port 3 through an ink tube 30. The print head 300 ejects each of the inks and prints a predetermined image on a print medium S under control of a control unit 400. Under the control of the control unit 400, an ink residue detection unit 400*a* obtains a result of detection by optical sensors 23 arranged for each of the ink cartridges 1 and determines the amount of ink residue in each of the ink cartridges 1.

Figure 2:
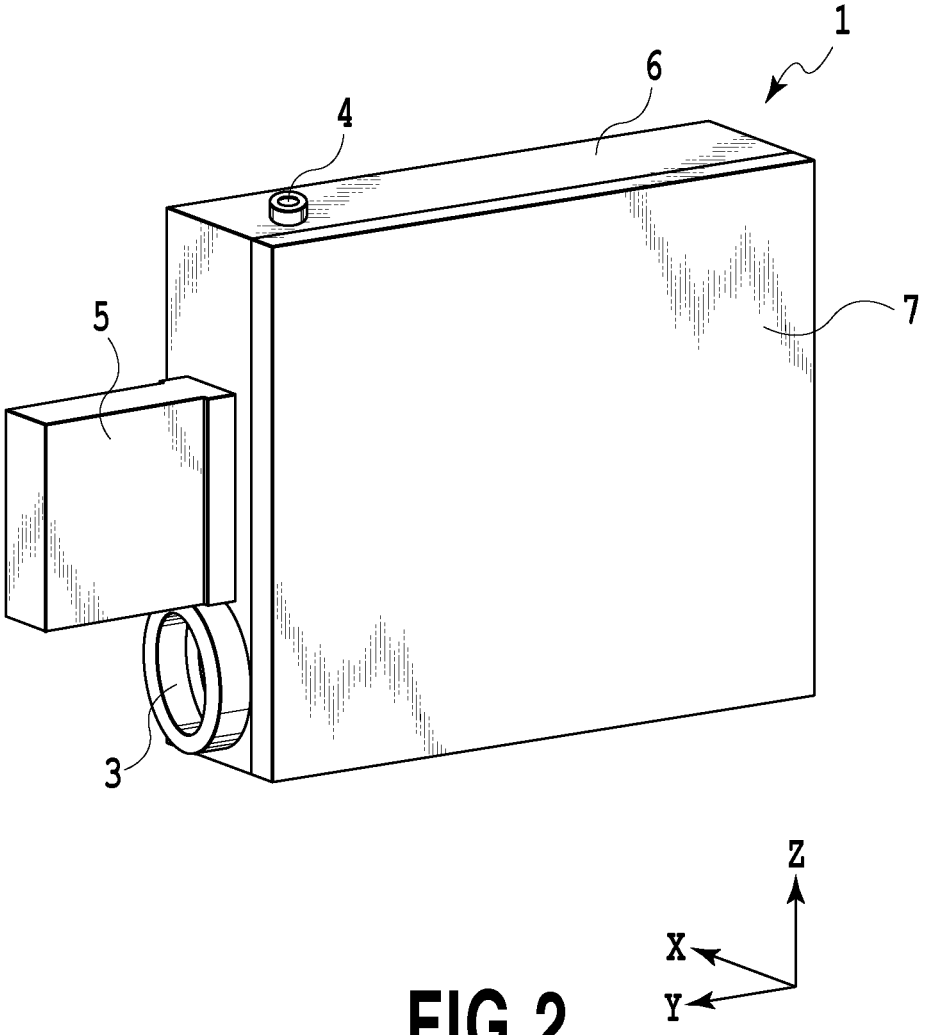
FIG. 2 is a perspective view of an external appearance of an ink cartridge.

FIG. 2 is a perspective view of an external appearance of the ink cartridge 1. The ink cartridge 1 comprises a container casing 6 for storing ink as a liquid and a container lid 7 bonded to the container casing 6 with ultrasonic welding or the like. An atmosphere communicating port 4 for keeping an atmospheric pressure within the ink cartridge 1 is provided on a surface in a +Z direction which is an upper side in a gravity direction at the time of mounting the ink cartridge 1, and the supply port 3 for supplying ink to the print head 300 is provided on a surface in a +Y direction. Further, a detection chamber 5 for detecting the amount of ink residue within the ink cartridge 1 is disposed on the side in the +Y direction.

Figure 3:
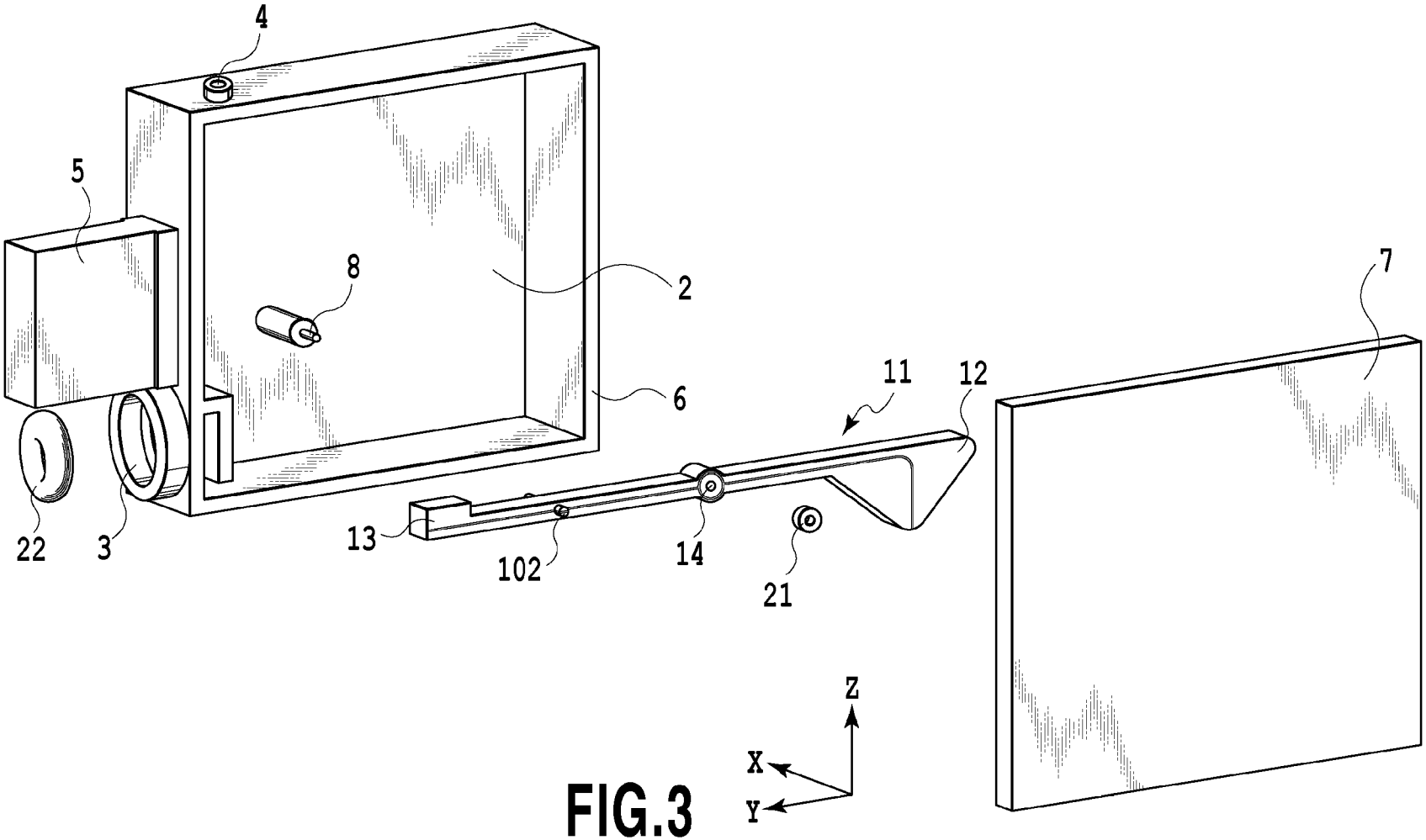
FIG. 3 is an exploded perspective view of the ink cartridge.

FIG. 3 is an exploded perspective view of the ink cartridge 1. The inside of the container casing 6 is a reservoir 2 for storing ink. On an inner wall of the reservoir 2, there is provided a shaft 8 formed thereon and protruded in a −X direction. A displacement member 11 is rotatably supported inside the reservoir 2 by having its shaft hole 14 pierced through the shaft 8 and further having a holding member 21 attached thereto. The displacement member 11 will be described later in detail. At the inside diameter of the supply port 3, there is provided a seal member 22.

Figure 4A:
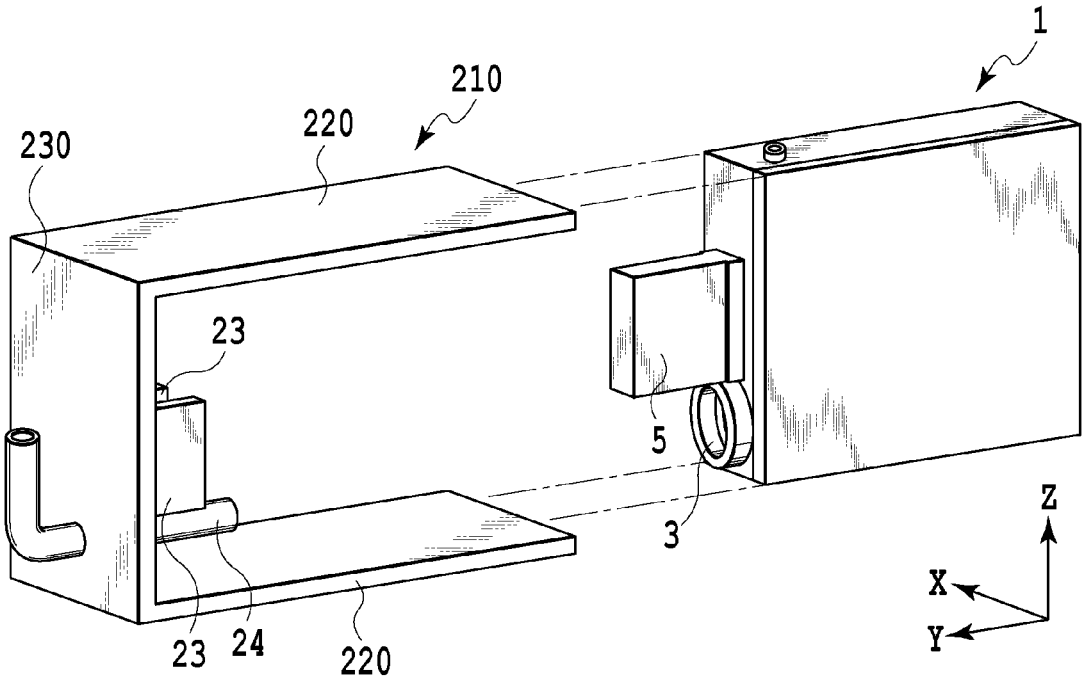
FIGS. 4A and 4B are views showing the state of mounting the ink cartridge.
Figure 4B:
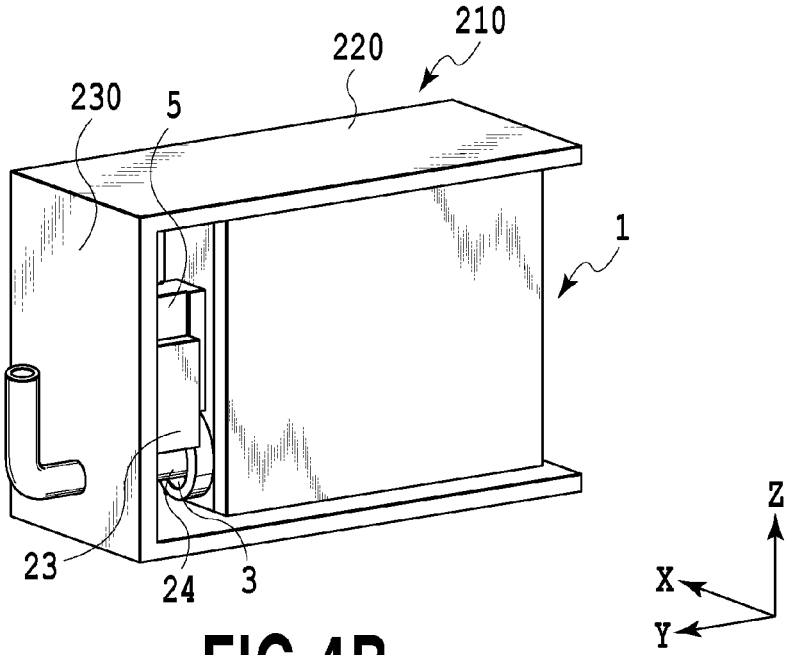

FIGS. 4A and 4B are views showing the state of mounting the ink cartridge 1 in a mounting unit 210 provided on the side of the inkjet printing apparatus 200. FIG. 4A shows a state before the mounting and FIG. 4B shows a state after the mounting. The mounting unit 210 comprises side face walls 220 guiding the ink cartridge 1, upon its mounting, in a mounting direction, and after the mounting, supporting it from the top and the bottom in a Z direction and a front face wall 230 that abuts on the ink cartridge 1, upon its mounting, in a Y direction.

The front face wall 230 has a pipe-shaped ink supply tube 24 which is pierced therethrough and which can be connected to the supply port 3. Inserting the ink supply tube 24 into the supply port 3 through the seal member 22 enables the inside of the reservoir 2 and the print head 300 to communicate with each other through the ink supply tube 24 and the ink tube 30.

Inside the front face wall 230, there is provided an optical sensor 23 having parts facing each other. One is a light-emitting part and the other is a light-receiving part. These parts are disposed so as to sandwich both sides of the detection chamber 5 in an X direction at the time of mounting the ink cartridge 1. In the ink cartridge 1, the side walls of the detection chamber 5 in the X direction are at least partially made of a light-transmitting material, and in the state in which the ink cartridge 1 is mounted, light emitted from the light-emitting part can be received at the light-receiving part. Incidentally, the mounting unit 210 as described above is independently prepared for each of the ink cartridges 1.

Figure 5A:
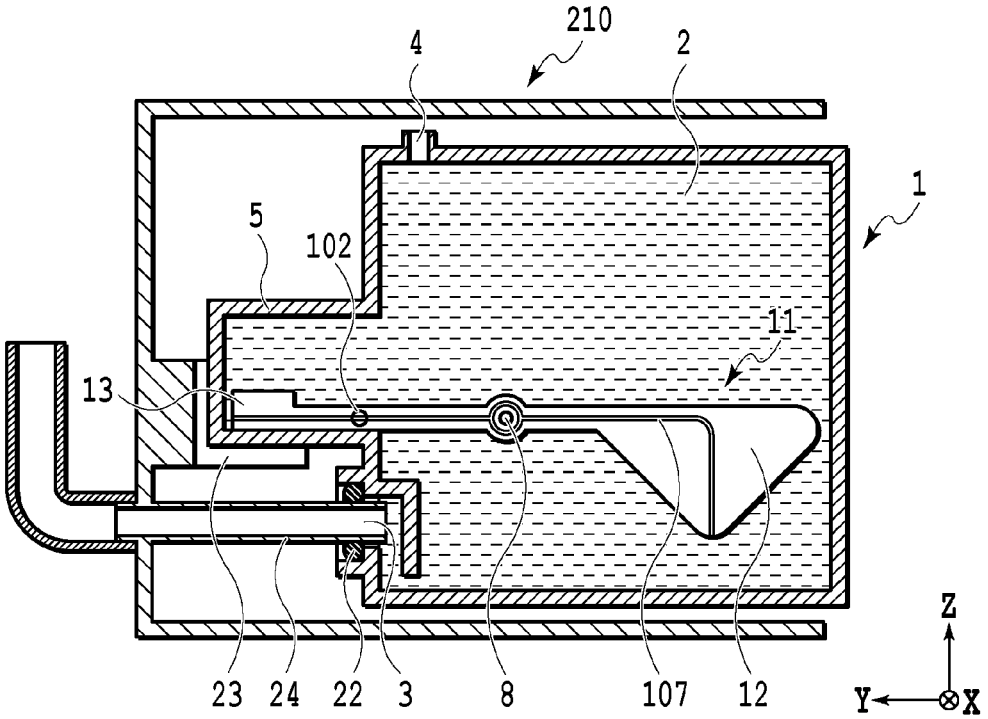
FIGS. 5A and 5B are cross-sectional views for explaining postures of a displacement member adapted to an ink residue.
Figure 5B:
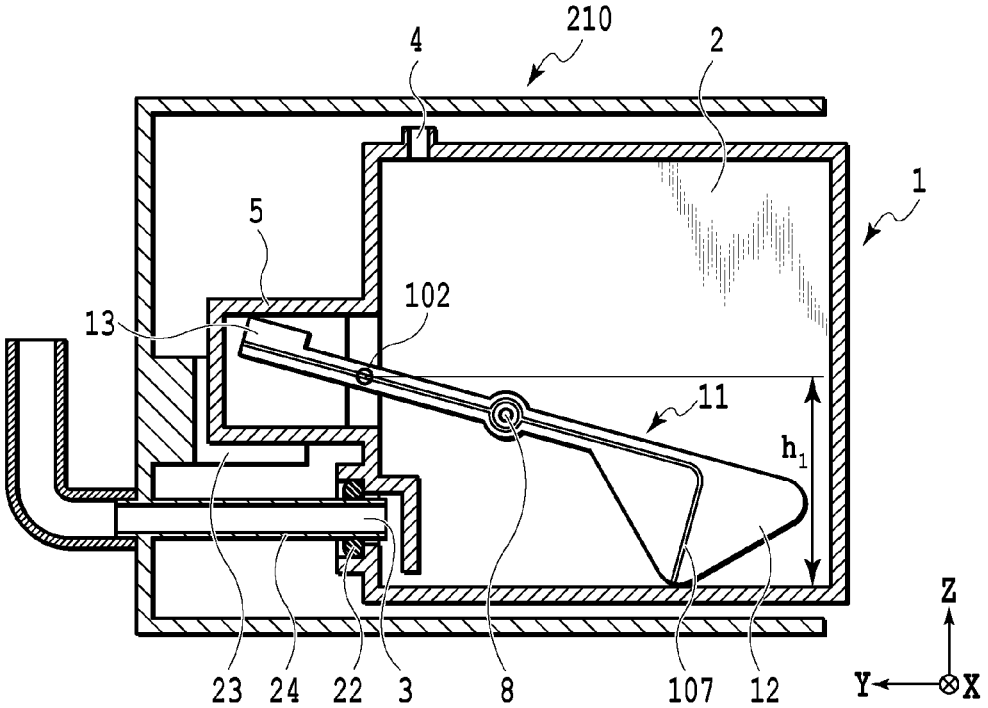

FIGS. 5A and 5B are cross-sectional views for explaining postures of the displacement member 11 corresponding to ink residues within the ink cartridge 1. FIG. 5A shows that the reservoir 2 is filled with ink and FIG. 5B shows that the ink hardly remains in the reservoir 2.

The displacement member 11, which is a rodlike member extending in the Y direction, comprises a light-shielding portion 13 formed at one end in the +Y direction and a float portion 12 formed at the other end in a −Y direction, and is configured to rotate around the shaft 8 within a Y-Z plane. However, an end area in the +Y direction including the light-shielding portion 13 is arranged within the detection chamber 5 which is narrower than the reservoir 2 in the Z direction, and therefore, the rotation of the displacement member 11 is limited due to the light-shielding portion 13 abutting on the inner walls of the detection chamber 5.

In the case where the reservoir 2 is filled with ink, the entire displacement member 11 is submerged in the ink. In such a case, the displacement member 11 of the present embodiment is designed so that rotational moment (in a counterclockwise direction) generated by float affected on the float portion 12 is greater than rotational moment (in a clockwise direction) generated by float affected on the light-shielding portion 13. Accordingly, in spite of the displacement member 11 trying to rotate counterclockwise, the rotation stops at a position where the light-shielding portion 13 abuts on the bottom of the detection chamber 5. As a result, the displacement member 11 takes a first posture as shown in FIG. 5A.

Meanwhile, in the case where the ink hardly remains in the reservoir 2, the displacement member 11 is exposed above the ink level. In such a case, the displacement member 11 of the present embodiment is designed so that rotational moment (in the clockwise direction) generated by gravity affected on the side of the float portion 12 is greater than rotational moment (in the counterclockwise direction) generated by gravity affected on the side of the light-shielding portion 13. Accordingly, in spite of the displacement member 11 trying to rotate clockwise, the rotation stops at a position where the light-shielding portion 13 abuts on the inner upper face of the detection chamber 5. As a result, the displacement member 11 takes a second posture as shown in FIG. 5B.

Such a change from the first posture to the second posture gradually proceeds along with ink consumption within the reservoir 2. Specifically, the light-shielding portion 13 gradually displaces in the Z direction (a first direction), that is, starting from the position where the light-shielding portion 13 abuts on the bottom of the detection chamber 5, passing through the position where the light-shielding portion 13 does not abut on the bottom or the upper face of the detection chamber 5, and reaching the position where the light-shielding portion 13 abuts on the upper face of the detection chamber 5. In the optical sensor 23, the light-emitting part and the light-receiving part are arranged at positions where, in the first posture, the light emitted by the light-emitting part is interrupted by the light-shielding portion 13 and is not received by the light-receiving part, and, in the second posture, the light emitted by the light-emitting part is received by the light-receiving part without being interrupted by the light-shielding portion 13. In other words, at timing when the ink within the reservoir 2 is consumed in a predetermined amount, the light-shielding portion 13 is out of an optical path of the optical sensor 23 and then the light-receiving part can receive the light. The ink residue detection unit 400*a* obtains this detection result to determine that the amount of ink residue within the ink cartridge 1 is very small.

Figure 6A:
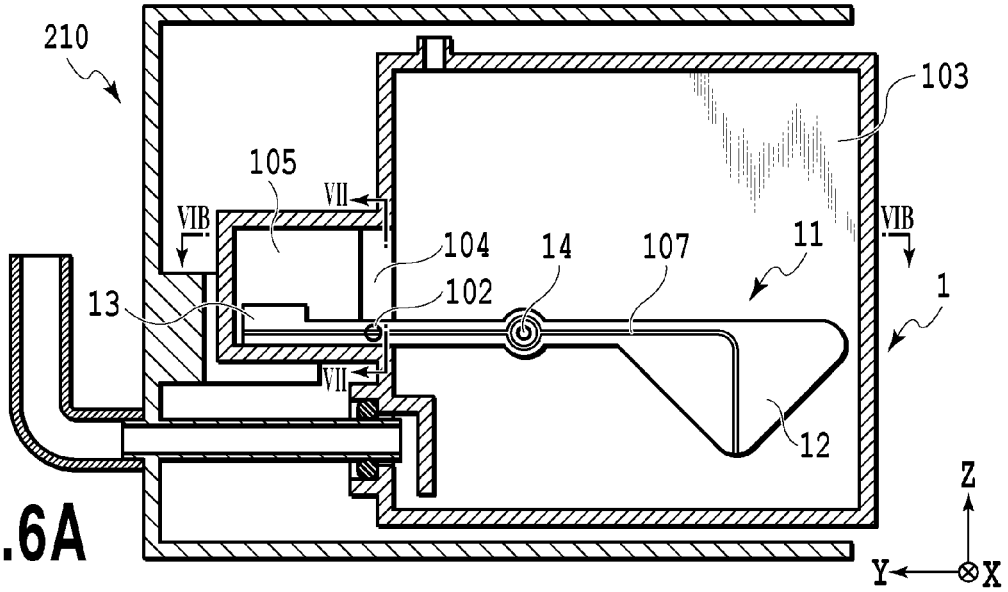
FIGS. 6A to 6C are views for explaining the specific structure of a detection chamber and the displacement member.
Figure 6B:
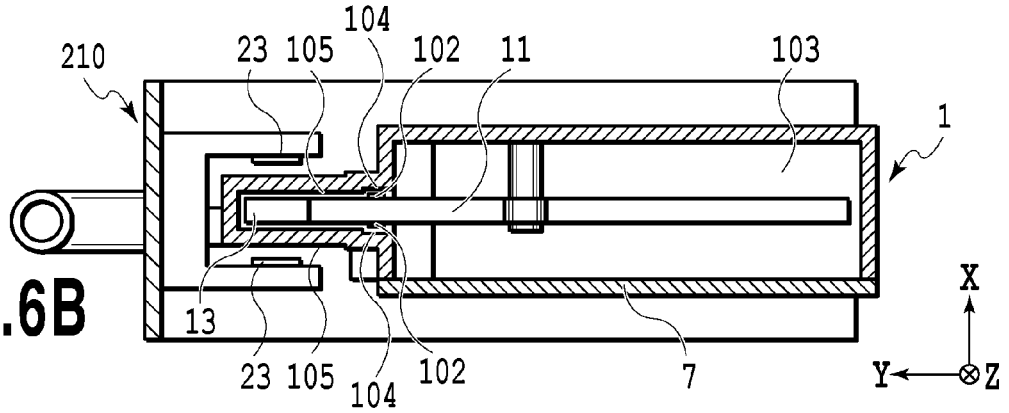
Figure 6C:
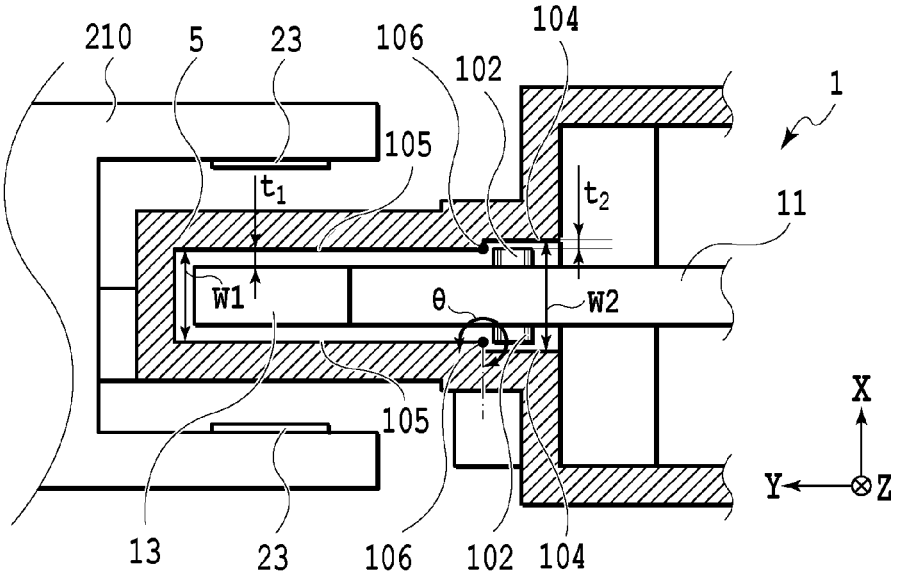

FIGS. 6A to 6C are views for further explaining the specific structure of the detection chamber 5 and the displacement member 11. FIG. 6B is a top view taken along line VIB-VIB in FIG. 6A and FIG. 6C is an enlarged view at the vicinity of the detection chamber 5.

Inside the detection chamber 5, there are provided two inner walls facing each other in the X direction, having first surfaces 105 (first areas) located at the sides of the +Y direction and second surfaces 104 (second areas) located at the sides of the −Y direction. A distance W2 in the X direction between the two second surfaces 104 facing each other is larger than a distance W1 in the X direction between the two first surfaces 105 facing each other. The first surfaces 105 and the second surfaces 104 are each connected via a ridgeline 106 having an inter-surface angle θ larger than 180 degrees and extending in the Z direction. FIG. 6C shows a case in which the inter-surface angle θ of the ridgeline 106 is 270 degrees.

Meanwhile, protrusions 102 are formed on both surfaces of the displacement member 11 facing the second surface 104 in the X direction and protruded toward the second surfaces 104. A distance t2 from the top end of the protrusion 102 to the second surface 104 is smaller than a distance t1 from the side surface of the light-shielding portion 13 to the first surface 105. In this regard, even if the entire displacement member 11 is somewhat shifted in a second direction (the X direction) that crosses the first direction (the Z direction), that is a substantial direction of displacement, the protrusion 102 abuts on the second surface 104 before the light-shielding portion 13 abuts on the first surface 105. Accordingly, a distance between the light-shielding portion 13 and the first surface 105 is ensured to the extent that a capillary force to inhibit the rotation of the displacement member 11 does not occur. Specifically, when the displacement member 11 gradually comes out from the ink level, it is suppressed that surface tension of the ink interposed between the light-shielding portion 13 and the first surface 105 inhibits the rotation of the displacement member 11. In other words, in order to achieve such an effect sufficiently, the distance t1 from the side surface of the light-shielding portion 13 to the first surface 105 and the distance t2 from the top end of the protrusion 102 to the second surface 104 are optimized by adjusting a protruding amount of the protrusion 102 and the arrangement of the first surface 105 and the second surface 104. As a result, in the state in which the light-shielding portion 13 is exposed above the ink level, the ink is unlikely to remain in a detection area of the optical sensor 23 on the first surface 105, and the optical sensor 23 can detect the amount of ink residue with high precision.

Meanwhile, since the distance t2 from the top end of the protrusion 102 to the second surface 104 is small, the ink may possibly remain in such a clearance. However, if the top area of the protrusion 102 is sufficiently small, surface tension of remaining ink allows suppressing inhibition of the rotation of the displacement member 11. In addition, the second surface 104 is connected to the first surface 105 via the ridgeline 106 which has the inter-surface angle θ=270 degrees with respect to the first surface 105. Accordingly, even if the ink remains in an area between the protrusion 102 and the second surface 104, there is little concern that the ink passes over the ridgeline 106 and reaches the first surface 105 and further reaches the detection area of the optical sensor 23.

Furthermore, according to the present embodiment, as another configuration to effectively remove the ink remaining in the clearance between the protrusion 102 and the second surface 104, grooves are formed on both sides of the displacement member 11. As shown in FIG. 6A, a groove 107 extends from the tip end of the light-shielding portion 13, through the protrusion 102 and the periphery of the shaft hole 14, and to the float portion 12, where the groove 107 bends downward in its midway to the end in a −Z direction.

Figure 7:
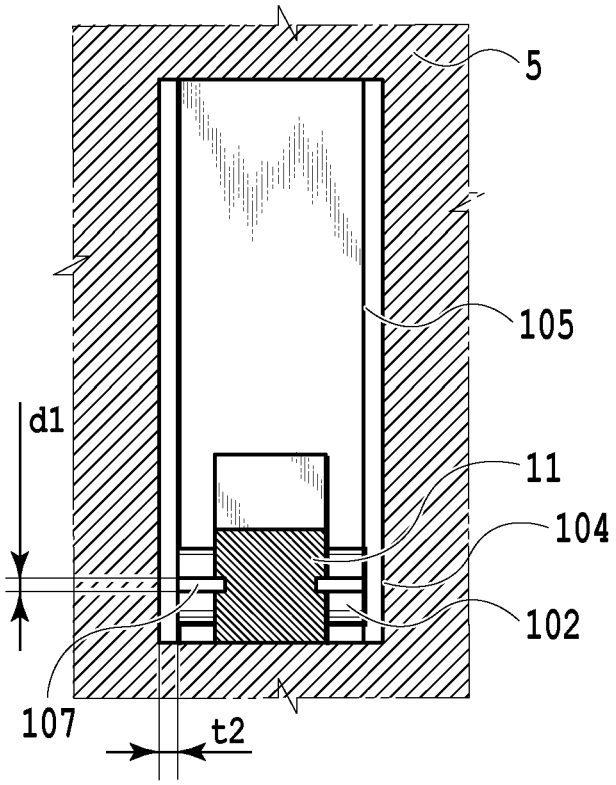
FIG. 7 is a view for explaining the specific structure of the detection chamber and the displacement member.

FIG. 7 is an anterior view taken along line VII-VII in FIG. 6A. At least a portion of the area of the groove 107 is formed so that a width d1 thereof is smaller than the distance t2 between the protrusion 102 and the second surface 104. Specifically, a capillary force at the width d1 of the groove 107 is larger than a force trying to hold the ink between the protrusion 102 and the second surface 104. Meanwhile, the width d1 is adjusted so that the capillary force occurred in the area is smaller than water head pressure corresponding to a water head difference h1 with respect to the ink level resulted in the second posture as shown in FIG. 5B. Specifically, the width d1 is adjusted so that the groove 107 draws up the ink remaining between the protrusion 102 and the second surface 104, but does not draw up the ink remaining in the reservoir 2 to the area even against gravity at least at the time of the second posture.

According to such a configuration, at timing when the protrusion 102 is just before displaced above the ink level, for example, the ink is communicated through the groove 107 that extends from the lower end of the float portion 12 to the ink level and the protrusion 102. Moreover, if the surface tension of the ink interposed between the protrusion 102 and the second surface 104 is large, there may be a concern of inhibiting the rotation of the displacement member 11. Meanwhile, according to the present embodiment, an ink holding force applied to the width d1 is designed to be larger than an ink holding force between the protrusion 102 and the second surface 104. As a result, the ink interposed between the protrusion 102 and the second surface 104 is guided along the groove 107, and in the case where the protrusion 102 is positioned above the ink level, the ink is unlikely to remain in the clearance between the protrusion 102 and the second surface 104.

Incidentally, in order to further achieve such an effect described above, in a process where the displacement member 11 gradually moves upward above the ink level while rotating about the shaft 8, it is preferable that the protrusion 102 constantly face the second surface 104. In this regard, the second surface 104 is preferably arranged such that its size is sufficiently larger than a trajectory of rotation of the protrusion 102 in the Y direction or such that its shape is an arc along with the trajectory of rotation of the protrusion 102.

As described above, according to the present embodiment, the displacement member 11 can be displaced at a position according to the ink residue without being influenced by the surface tension of the ink. Further, in the case where the light-shielding portion 13 comes above the ink level, the ink is unlikely to remain in the detection area of the optical sensor 23 on the first surface 105. As a result, the optical sensor can achieve appropriate detection with high precision according to the amount of ink residue.

Incidentally, according to the embodiment described above, each of the members may be changed in variation within the range of functions described above. For example, attachment of the displacement member 11 to the container casing 6 may have a configuration in which the container casing 6 comprises a hole and the displacement member 11 comprises a shaft. In any case, it is only required that the displacement member 11 be rotatably attached with respect to the container casing 6.

Moreover, according to the above embodiment, the protrusion 102 is formed on the displacement member and the second surface 104 is formed on the inner wall of the detection chamber 5, and the distance t2 therebetween is specified in a predetermined value, but the present invention is not limited to such an embodiment. For example, a configuration can be employed in which a smooth regulating member is used for the area of the displacement member 11 and a convex rib shape extending along the position of the rotation of the displacement member 11 is provided on the second area corresponding to the second surface 104 of the detection chamber 5.

Furthermore, the explanation has been given that the first surface and the second surface are connected via one ridgeline 106 having an inter-surface angle larger than 180 degrees, but the present invention is not limited to such an embodiment. For example, these two surfaces may be directly connected with an inter-surface angle larger than 180 degrees. If at least one ridgeline having an inter-surface angle larger than 180 degrees is located between the first surface and the second surface, the ink held at the side of the second surface 104 cannot move to the side of the first surface 105 easily, which is the detection area.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-230601 filed Nov. 26, 2015, which is hereby incorporated by reference wherein in its entirety.

What is claimed is:

1. A liquid container mountable to an apparatus in which an optical sensor is installed, the liquid container comprising:

a reservoir storing a liquid;

a detection chamber which communicates with the reservoir and which is located at a position detectable by the optical sensor in a state where the liquid container is mounted in the apparatus; and a displacement member configured to displace to a first direction in the reservoir and the detection chamber according to an amount of liquid stored in the reservoir, wherein the displacement member includes a light shielding part which moves, according to the displacement, within the detection chamber between a position where light of the optical sensor is shielded and a position where the light of the optical sensor is not shielded and a regulating member for regulating movement of the displacement member in a second direction that crosses the first direction, an inner wall of the detection chamber has a first area that faces the light shielding part and at least of a portion of that is formed of a material transmitting the light of the optical sensor and a second area that faces the regulating member in the second direction, and the first area and the second area are connected via a ridgeline having an inter-surface angle larger than 180 degrees.

2. The liquid container according to claim 1, wherein, in the second direction, a distance between the first area and the light shielding part is larger than a distance between the second area and the regulating member.

3. The liquid container according to claim 1, wherein the displacement member is rotatably attached to a shaft provided within the reservoir and is rotated according to the amount of liquid stored in the reservoir to be displaced in the first direction.

4. The liquid container according to claim 1, wherein, in the displacement member, the regulating member is arranged at a position close to the reservoir compared to the light shielding part.

5. The liquid container according to claim 1, wherein the second area is provided along an area where the regulating member moves along with the displacement.

6. The liquid container according to claim 1, wherein the displacement member includes a groove having a width smaller than a distance between the second area and the regulating member in the second direction.

7. The liquid container according to claim 1, wherein the liquid is an ink for printing an image.

8. A liquid container mountable to an apparatus in which an optical sensor is installed, the liquid container comprising:

a reservoir storing a liquid;

a detection chamber which communicates with the reservoir and which is located at a position detectable by the optical sensor in a state where the liquid container is mounted in the apparatus; and a displacement member configured to displace to a first direction in the reservoir and the detection chamber according to an amount of liquid stored in the reservoir, wherein the displacement member includes a light shielding part which moves, according to the displacement, within the detection chamber between a position where light of the optical sensor is shielded and a position where the light of the optical sensor is not shielded and a regulating member for regulating movement of the displacement member in a second direction that crosses the first direction, an inner wall of the detection chamber has a first area that faces the light shielding part and at least of a portion of that is formed of a material transmitting the light of the optical sensor and a second area that faces the regulating member in the second direction, and the first area and the second area are connected with an inter-surface angle larger than 180 degrees.

9. The liquid container according to claim 8, wherein, in the second direction, a distance between the first area and the light shielding part is larger than a distance between the second area and the regulating member.

10. The liquid container according to claim 8, wherein the displacement member is rotatably attached to a shaft provided within the reservoir and is rotated according to the amount of liquid stored in the reservoir to be displaced in the first direction.

11. The liquid container according to claim 8, wherein, in the displacement member, the regulating member is arranged at a position close to the reservoir compared to the light shielding part.

12. The liquid container according to claim 8, wherein the second area is provided along an area where the regulating member moves along with the displacement.

13. The liquid container according to claim 8, wherein the displacement member includes a groove having a width smaller than a distance between the second area and the regulating member in the second direction.

14. The liquid container according to claim 8, wherein the liquid is an ink for printing an image.

15. A liquid residue detection apparatus comprising:

a mounting unit capable of mounting a liquid container therein;

an optical sensor; and a determining unit configured to determine an amount of liquid residue stored in the liquid container based on a result of detection by the optical sensor, wherein the liquid container includes a reservoir storing a liquid, a detection chamber which communicates with the reservoir and which is located at a position detectable by the optical sensor in a state where the liquid container is mounted in the apparatus, and a displacement member configured to displace to a first direction in the reservoir and the detection chamber according to an amount of liquid stored in the reservoir, and wherein the displacement member includes a light shielding part which moves, according to the displacement, within the detection chamber between a position where light of the optical sensor is shielded and a position where the light of the optical sensor is not shielded and a regulating member for regulating movement of the displacement member in a second direction that crosses the first direction, an inner wall of the detection chamber has a first area that faces the light shielding part and at least of a portion of that is formed of a material transmitting the light of the optical sensor and a second area that faces the regulating member in the second direction, and the first area and the second area are connected via a ridgeline having an inter-surface angle larger than 180 degrees.

16. The liquid residue detection apparatus according to claim 15, further comprising a printing unit configured to print an image on a print medium by ejecting the liquid.

* * * * *